US005906172A

United States Patent [19]

Kordes

[11] Patent Number: 5,906,172

[45] Date of Patent: May 25, 1999

[54] PLURALITY OF FLOATS CONNECTABLE FOR FORMING VARIOUS FLOATING STRUCTURES

[76] Inventor: Michael John Kordes, 472 Mantoloking Rd., Brick, N.J. 08723

[21] Appl. No.: 09/024,190

[22] Filed: Feb. 17, 1998

[51] Int. Cl.[6] ..... B63B 35/44; B63B 35/58

[52] U.S. Cl. ..... 114/267; 441/40

[58] Field of Search ..... 405/195.1, 218, 405/219, 220; 114/266, 267, 345; 441/40, 50; 403/389, 384, 393, 402, 403; 248/220.1

[56] References Cited

U.S. PATENT DOCUMENTS 1,727,289 9/1929 Johnson ..... 441/50
5,197,404 3/1993 Haley et al. ..... 114/267
5,226,184 7/1993 Cheng ..... 5/417
5,791,958 8/1998 Yeung ..... 441/130

*Primary Examiner*—Tamara Graysay
*Assistant Examiner*—Sunil Singh

[57] ABSTRACT

A plurality of floats connectable for forming various floating structures including a plurality of inflatable floats each with a generally triangular configuration. Further provided are a plurality of metal brackets coupled on the top face of each of the floats. Finally, a plurality of coupling mechanisms are provided for being selectively secured between different metal brackets thereby maintaining the relative position of the floats.

1 Claim, 3 Drawing Sheets

PLURALITY OF FLOATS CONNECTABLE FOR FORMING VARIOUS FLOATING STRUCTURES

BACKGROUND OF THE INVENTION

1. Field of the Invention

The present invention relates to a plurality of floats connectable for forming various floating structures and more particularly pertains to allowing the construction of various floating structures such as circular platforms, walk ways, and a combination thereof for use during a time of flooding.

2. Description of the Prior Art

The use of floating structures is known in the prior art. More specifically, floating structures heretofore devised and utilized for the purpose of allowing a user to reside above water are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,297,899 to Culley; U.S. Pat. No. 5,281,055 to Neizke et al; U.S. Patent Des. 333,707 to Cerbone; U.S. Pat. No. 5,390,620 to Murphy; U.S. Pat. No. 4,260,293 to Peterson; and U.S. Pat. No. 4,727,820 to Klaus.

In this respect, the plurality of floats connectable for forming various floating structures according to the present invention substantially departs from the conventional concepts and designs of the prior art, and in so doing provides an apparatus primarily developed for the purpose of allowing the construction of various floating structures such as circular platforms, walk ways, and a combination thereof for use during a time of flooding.

Therefore, it can be appreciated that there exists a continuing need for a new and improved plurality of floats connectable for forming various floating structures which can be used for allowing the construction of various floating structures such as circular platforms, walk ways, and a combination thereof for use during a time of flooding. In this regard, the present invention substantially fulfills this need.

SUMMARY OF THE INVENTION

In view of the foregoing disadvantages inherent in the known types of floating structures now present in the prior art, the present invention provides an improved plurality of floats connectable for forming various floating structures. As such, the general purpose of the present invention, which will be described subsequently in greater detail, is to provide a new and improved plurality of floats connectable for forming various floating structures which has all the advantages of the prior art and none of the disadvantages.

To attain this, the present invention essentially comprises a plurality of inflatable floats. Each float has a generally triangular configuration with a top face and a bottom face with a length less than that of the top face. The floats each also have a large arcuate outboard face, a planar rectangular inboard face extending outwardly between the top face and the bottom face, and a pair of side faces integrally coupled therebetween defining an interior space. As shown in FIG. 1, an inflation valve is centrally situated on the top face for allowing inflation of the float. Further provided is a plurality of metal brackets coupled on the top faces of each of the floats. Each metal bracket has an outboard arcuate rail situated in parallel with and adjacent to the outboard face of the float. An inboard rail is situated in parallel with and adjacent to the inboard face. Integrally coupled between ends of the outboard rail and the inboard rail is a pair of linear side rails which are positioned adjacent the side faces of the float. Each metal bracket further includes a pair of spaced threaded apertures formed in each end of both the outboard rail and the inboard rail. It should be noted that each pair of apertures is formed along an arcuate curve which the associated rail defines. For affording stability of the float in water, a plurality of thin weight plates are included. Each weight plate has a size and shape similar to that of the bottom face of the floats. In use, each weight is attached to an exterior surface of the bottom face of an associated float. For maintaining the relative position of two floats, a plurality of first coupling mechanisms are provided. See FIGS. 5 & 6. Each first coupling mechanism includes a thin rectangular metal strip with a first end and a second each with a pair of spaced apertures formed therein. Such apertures are adapted for allowing the insertion of screws therethrough for coupling with the threaded apertures of an associated metal bracket. For maintaining the relative position of three floats, a plurality of second coupling mechanisms are included each with a thin rectangular metal strip having a generally L-shaped configuration. Such second coupling mechanism has a first slightly arcuate portion with a first end having pair of apertures formed therein. As shown in FIG. 5, the second coupling mechanism further has a second linear portion with a first end integrally coupled to a second end of the first arcuate portion. A pair of spaced apertures are formed in the first portion of the second coupling mechanism. The second linear portion of the second mechanism further has a second end also with a pair of spaced apertures formed therein. By this structure, the apertures are adapted for allowing the insertion of screws therethrough for coupling with the threaded apertures of an associated metal bracket. Associated therewith is a plurality of third coupling mechanisms also included for maintaining the relative position of three floats. Each third coupling mechanism has a thin rectangular metal strip with a generally L-shaped configuration, similar to the second coupling mechanisms. Each third coupling mechanism has a first portion having pair of apertures formed therein. Further provided is a second linear portion with a first end having a pair of spaced apertures formed therein and a second end also with a pair of spaced apertures formed therein. A third slightly arcuate portion is coupled between the first portion and the first end of the second portion such that the first portion resides perpendicularly with respect to the first portion. In use, the apertures are adapted for allowing the insertion of screws therethrough for coupling with the threaded apertures of an associated metal bracket.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved plurality of floats connectable for forming various floating structures which has all the advantages of the prior art floating structures and none of the disadvantages.

It is another object of the present invention to provide a new and improved plurality of floats connectable for forming various floating structures which may be easily and efficiently manufactured and marketed.

It is a further object of the present invention to provide a new and improved plurality of floats connectable for forming various floating structures which is of a durable and reliable construction.

An even further object of the present invention is to provide a new and improved plurality of floats connectable for forming various floating structures which is susceptible of a low cost of manufacture with regard to both materials and labor, and which accordingly is then susceptible of low prices of sale to the consuming public, thereby making such plurality of floats connectable for forming various floating structures economically available to the buying public.

Still yet another object of the present invention is to provide a new and improved plurality of floats connectable for forming various floating structures which provides in the apparatuses and methods of the prior art some of the advantages thereof, while simultaneously overcoming some of the disadvantages normally associated therewith.

Still another object of the present invention is to allow the construction of various floating structures such as circular platforms, walk ways, and a combination thereof for use during a time of flooding.

Lastly, it is an object of the present invention to provide a new and improved plurality of floats connectable for forming various floating structures including a plurality of inflatable floats each with a generally triangular configuration. Further provided are a plurality of metal brackets coupled on the top face of each of the floats. Finally, a plurality of coupling mechanisms are provided for being selectively secured between different metal brackets thereby maintaining the relative position of the floats.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OP THE PREFERRED EMBODIMENT

Figure 1:
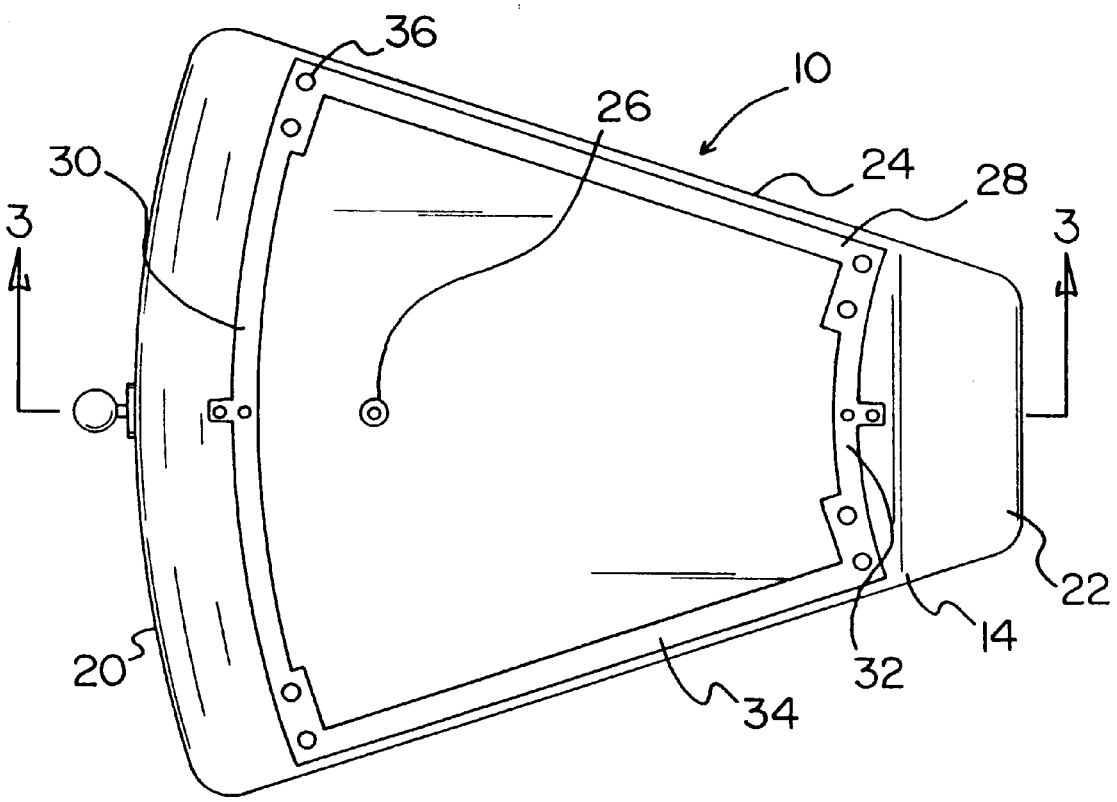
FIG. 1 is a perspective illustration of the preferred embodiment of the plurality of floats connectable for forming various floating structures constructed in accordance with the principles of the present invention.
Figure 2:
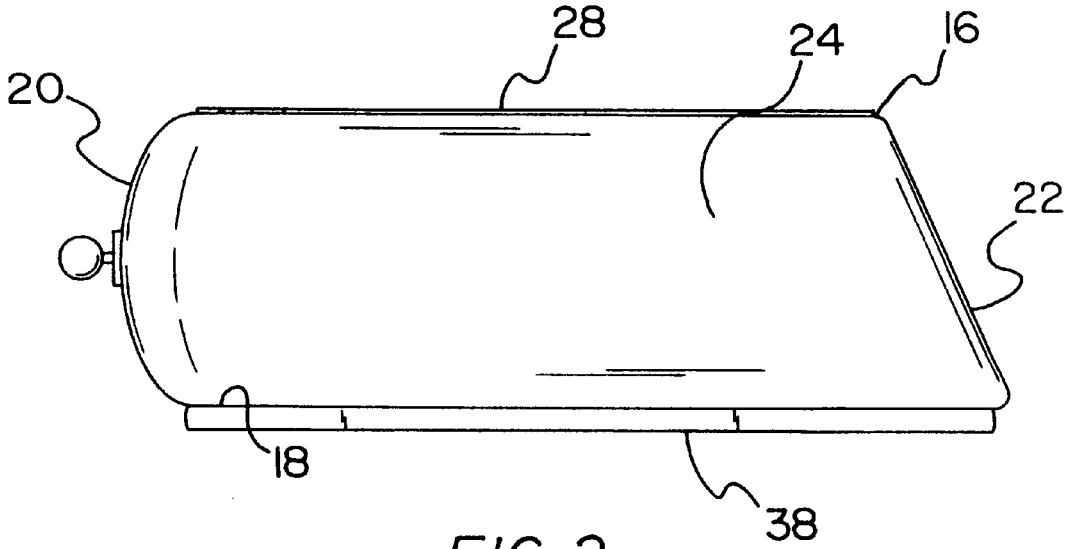
FIG. 2 is a side elevational view of a float of the present invention.
Figure 3:
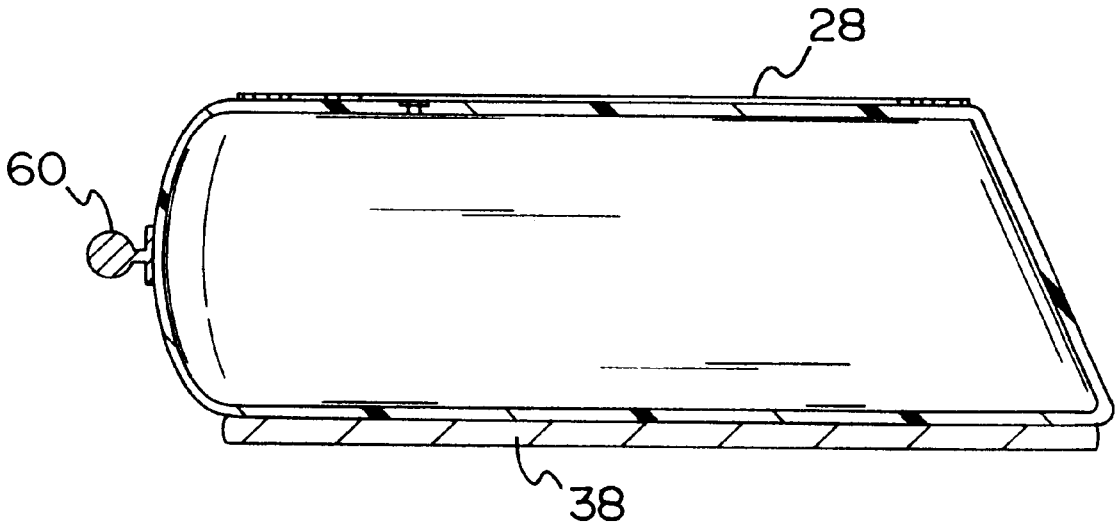
FIG. 3 is a cross-sectional view of a float taken along line 3—3 shown in FIG. 1.
Figure 4:
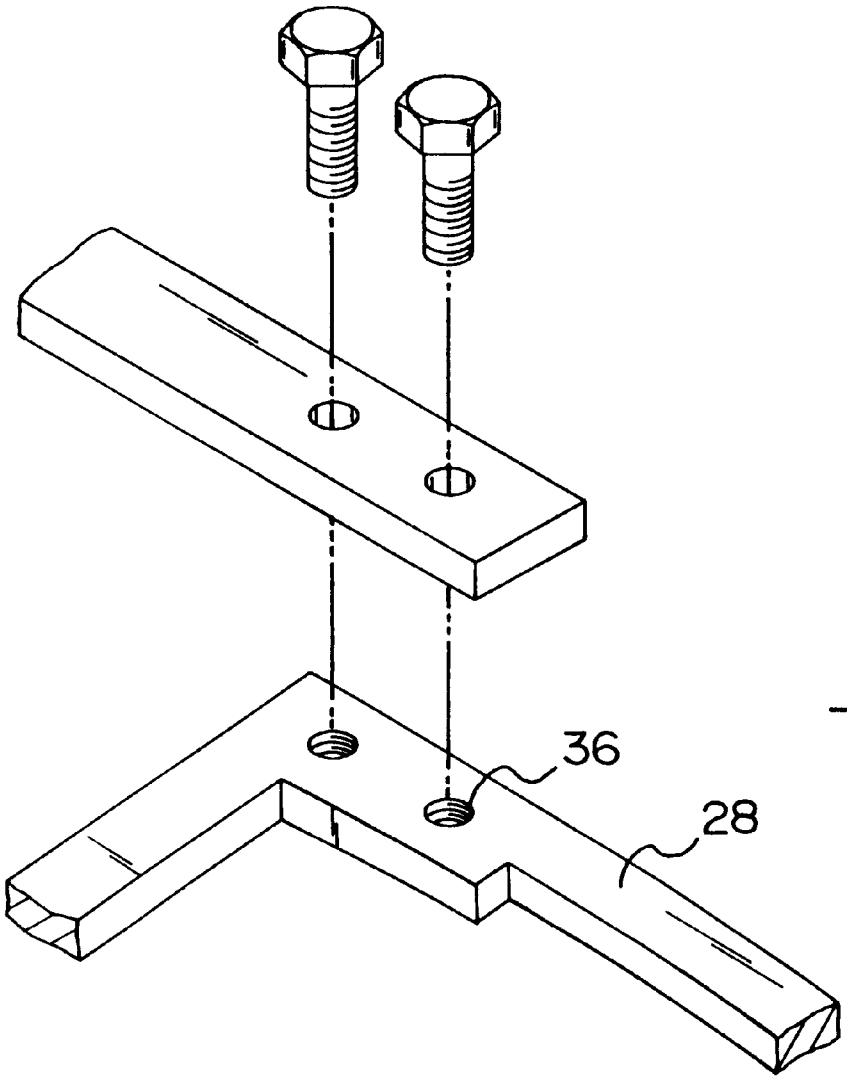
FIG. 4 is a close-up view of the coupling of the metal bracket and one of the coupling mechanisms.

With reference now to the drawings, and in particular to FIG. 1 thereof, a new and improved plurality of floats connectable for forming various floating structures embodying the principles and concepts of the present invention and generally designated by the reference numeral 10 will be described.

The present invention, the new and improved plurality of floats connectable for forming various floating structures, is comprised of a plurality of components. Such components in their broadest context include a plurality of floats, metal brackets, weights, and coupling mechanism. Such components are individually configured and correlated with respect to each other so as to attain the desired objective.

More specifically, it will be noted that the system 10 of the present invention includes a plurality of inflatable floats 14. Each float has a generally triangular configuration with a top face 16 and a bottom face 18 with the bottom face having a length less than that of the top face. The floats each also have a large arcuate outboard 20 face, a planar rectangular inboard face 22 extending outwardly between the top face and the bottom face, and a pair of side faces 24 integrally coupled therebetween defining an interior space. By this structure, when the floats are interconnected in a circular configuration by means that will be discussed in greater detail later, an annular bevelled edge is defined for supporting a structure such as a hot tub or the like therein. As shown in FIG. 1, an inflation valve 26 is centrally situated on the top face for allowing inflation of the float.

Further provided is a plurality of metal brackets 28 coupled on the top faces of each of the floats. Each metal bracket has an outboard arcuate rail 30 situated in parallel with and adjacent to the outboard face of the float. An inboard rail 32 is situated in parallel with and adjacent to the inboard face. Integrally coupled between ends of the outboard rail and the inboard rail is a pair of linear side rails 34 which are positioned adjacent the side faces of the float. Each metal bracket further includes a pair of spaced threaded apertures 36 formed in each end of both the outboard rail and the inboard rail. It should be noted that each pair of apertures is formed along an arcuate curve which the associated rail defines. As an option, secondary spaced apertures may be formed in a central extent of the inboard and outboard rails to provided additional versatility as will become apparent later.

For affording stability of the float in water, a plurality of thin weight plates 38 are included. Each weight plate has a size and shape similar to that of the bottom face of the floats. In use, each weight is attached to an exterior surface of the bottom face of an associated float, thereby also affording protection of each float.

Figure 5:
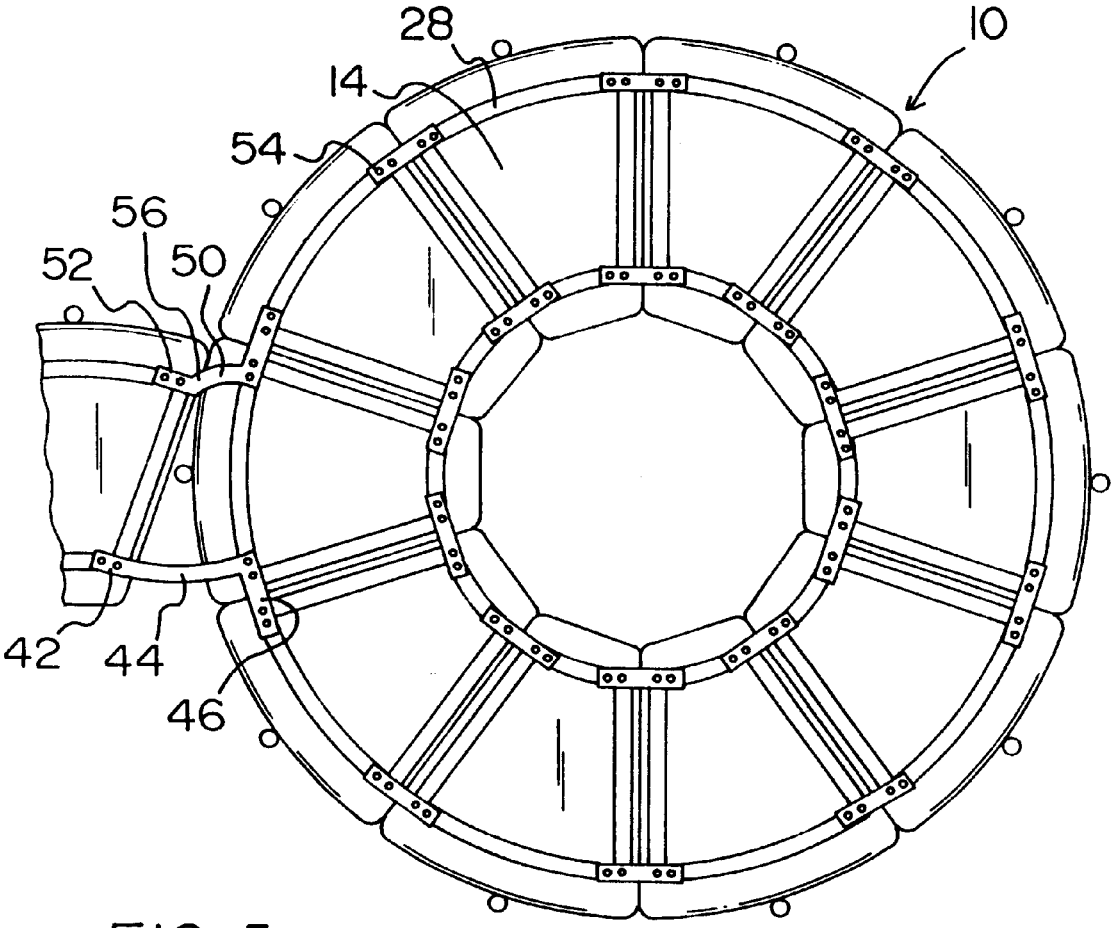
FIG. 5 is a top plan view of the floats linked to form a circular platform.
Figure 6:
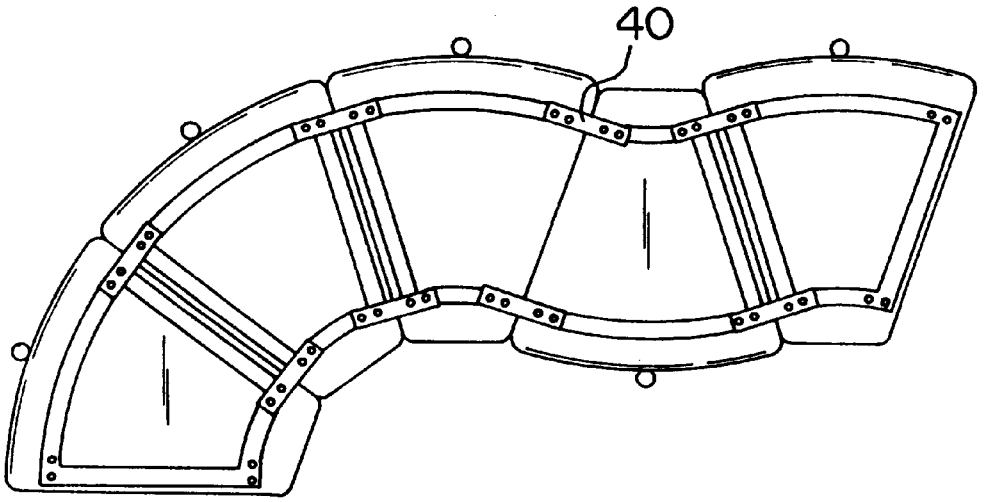
FIG. 6 is a top plan view of the floats linked to form a walk way.

For maintaining the relative position of two floats, a plurality of first coupling mechanisms 40 are provided. See FIGS. 5 & 6. Each first coupling mechanism includes a thin rectangular metal strip with a first end and a second each having a pair of spaced apertures formed therein. Such apertures are adapted for allowing the insertion of screws therethrough for coupling with the threaded apertures of an associated metal bracket. Preferably, the screws have a head with a hexagonal cross-section. As shown in FIGS. 5 & 6, the first coupling mechanisms may be utilized to construct both platforms and walkways.

For maintaining the relative position of three floats, a plurality of second coupling mechanisms 42 are included each with a thin rectangular metal strip having a generally L-shaped configuration. Such second coupling mechanism has a first slightly arcuate portion 44 with a first end having pair of apertures formed therein. As shown in FIG. 5, the second coupling mechanism further has a second linear portion 46 with a first end integrally coupled to a second end of the first arcuate portion. A pair of spaced apertures are formed in the first portion of the second coupling mechanism. The linear portion of the second mechanism further has a second end also with a pair of spaced apertures formed therein. By this structure, the apertures are adapted for allowing the insertion of screws therethrough for coupling with the threaded apertures of an associated metal bracket.

Associated therewith is a plurality of third coupling mechanisms 50 also included for maintaining the relative position of three floats. Each third coupling mechanism has a thin rectangular metal strip with a generally L-shaped configuration, similar to the second coupling mechanisms. Each third coupling mechanism has a first portion 52 having pair of apertures formed therein. Further provided is a second linear portion 54 with a first end having a pair of spaced apertures formed therein and a second end also with a pair of spaced apertures formed therein. A third slightly arcuate portion 56 is coupled between the first portion and the first end of the second portion such that the first portion resides perpendicularly with respect to the second portion. In use, the apertures are adapted for allowing the insertion of screws therethrough for coupling with the threaded apertures of an associated metal bracket. It should be noted that the second and third coupling mechanism are designed especially for combining a platform structure and a walkway structure such that the walkway extends radially outwardly away from the platform.

The present invention allows the construction of various floating structures such as circular platforms, walk ways, and the combinations thereof during a time of flooding. As shown in FIG. 5, the platform is suitably annular. To construct a walkway, as shown in FIG. 6, the floats may be interconnected with each edge being formed of a plurality of inboard and outboard faces of the floats.

Optionally, a bulb 60 may be coupled to a central extent of the outboard face of each housing, as shown in the Figures. Such bulbs allow a tent to be secured onto the platform as shown in FIG. 6 and further allow anchoring of the device.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A plurality of floats connectable for forming various floating structures comprising, in combination:

a plurality of inflatable floats each with a generally triangular configuration with a top face, a bottom face with a length less than that of the top face, a large arcuate outboard face, a planar rectangular inboard face extending outwardly between the top face and the bottom face, and a pair of side faces integrally coupled therebetween defining an interior space, wherein an inflation valve is centrally situated on the top face for allowing inflation of the float;

a plurality of metal brackets coupled on the top faces of each of the floats, each metal bracket having an outboard arcuate rail situated in parallel with and adjacent to the outboard face of the float, an inboard rail situated in parallel with and adjacent to the inboard face, and a pair of linear side rails integrally coupled between ends of the outboard rail and the inboard rail and further positioned adjacent the side faces of the float, each metal bracket further including a pair of spaced threaded apertures formed in each of both the outboard rail and the inboard rail with each pair of apertures formed along a arcuate curve which the associated rail defines;

a plurality of thin weight plates each with a size and a shape similar to that of the bottom face of the floats, each weight attached to an exterior surface of the bottom face of an associated float;

a plurality of first coupling mechanisms for maintaining the relative position of two floats, each first coupling mechanism including a thin rectangular metal strip with a first end and a second end each with a pair of spaced apertures formed therein for allowing the insertion of screws therethrough for coupling with the threaded apertures of an associated metal bracket;

a plurality of second coupling mechanisms for maintaining the relative position of three floats, each second coupling mechanism including a thin rectangular metal strip with a generally L-shaped configuration having a first slightly arcuate portion with a first end having a pair of apertures formed therein, the second coupling mechanism further having a second linear portion with a first end integrally coupled to a second end of the first arcuate portion with a pair of spaced apertures formed therein and a second end also with a pair of spaced apertures formed therein, wherein the apertures are adapted for allowing the insertion of screws therethrough for coupling with the threaded apertures of an associated metal bracket; and a plurality of third coupling mechanisms for maintaining the relative position of three floats, each third coupling mechanism including a thin rectangular metal strip with a generally L-shaped configuration having a first portion having a pair of apertures formed therein, a second linear portion with a first end having a pair of spaced apertures formed therein and a second end also with a pair of spaced apertures formed therein, and a third slightly arcuate portion coupled between the first portion and the first end of the second portion such that the first portion resides perpendicularly with respect to the second portion, wherein the apertures are adapted for allowing the insertion of screws therethrough for coupling with the threaded apertures of an associated metal bracket.

* * * * *